US009056344B2

(12) United States Patent
Müller et al.

(10) Patent No.: US 9,056,344 B2
(45) Date of Patent: Jun. 16, 2015

(54) METHOD FOR PRODUCING HOT ROLLED HOLLOW SECTIONS HAVING A RECTANGULAR CROSS-SECTION AND SMALL EDGE RADII

(75) Inventors: Thomas Müller, Rheinberg (DE); Nicolas Trapp, Duisburg (DE); Norbert Arzt, Neuss (DE); Burkhard Helten, Duisburg (DE); Thorsten Schmitz, Krefeld (DE)

(73) Assignee: Vallourec Deutschland GmbH, Düsseldorf (DE)

( * ) Notice: Subject to any disclaimer, the term of this patent is extended or adjusted under 35 U.S.C. 154(b) by 519 days.

(21) Appl. No.: 13/393,030

(22) PCT Filed: Aug. 12, 2010

(86) PCT No.: PCT/DE2010/000974

§ 371 (c)(1),
(2), (4) Date: May 14, 2012

(87) PCT Pub. No.: WO2011/023167

PCT Pub. Date: Mar. 3, 2011

(65) Prior Publication Data

US 2012/0244372 A1 Sep. 27, 2012

(30) Foreign Application Priority Data

Aug. 28, 2009 (DE) ..... 10 2009 039 710

(51) Int. Cl.
*B21C 37/15* (2006.01)
*B21D 3/14* (2006.01)
(Continued)

(52) U.S. Cl.
CPC ..... *B21C 37/15* (2013.01); *Y10T 428/12292* (2015.01); *B21D 3/14* (2013.01); *B21D 47/01* (2013.01); *B66C 23/286* (2013.01); *B66C 23/62* (2013.01)

(58) Field of Classification Search
CPC ..... B21C 37/15; B21C 37/30; B21D 3/14; B21D 5/12; B21D 51/2646; B21D 47/01; B21B 13/12; B21B 13/10; B21B 31/16; E04C 3/32
USPC ..... 72/367.1, 370.26, 370.23, 368
See application file for complete search history.

(56) References Cited

U.S. PATENT DOCUMENTS 5,423,201 A * 6/1995 Steinmair et al. ..... 72/225
5,868,299 A * 2/1999 Abbey, III ..... 228/147
(Continued)

FOREIGN PATENT DOCUMENTS

DE 10 2006 010 951 A1 9/2007
DE 10 2007 031142 A1 1/2009
(Continued)

*Primary Examiner* — Shelley Self
*Assistant Examiner* — Gregory Swiatocha
(74) *Attorney, Agent, or Firm* — Henry M. Feiereisen LLC

(57) ABSTRACT

In a method for producing hot-rolled sections of steel with a rectangular or square cross-section, a substantially round pipe blank produced seamlessly by hot rolling or cold finished and welded and having a defined nominal outside diameter is initially produced and then formed at a forming temperature into a hollow section having the required cross-section, with visible edges C1 and C2 of the hollow section having a value ≤1.5×t (t=wall thickness). The pipe blank has a nominal outer diameter determined from a reduction ratio of the pipe blank to be achieved and the hollow section dimensions to be achieved, wherein the reduction ration lies within a range of −2% to −13% and is determined according to the following formula:

$$\text{Reduction ratio } R[\%]=[(2\times(H+B))-\pi\times D]\times 100\%/[2\times(H+B)].$$

4 Claims, 1 Drawing Sheet

(51) Int. Cl.

| | |
|---|---|
| ***B21D 47/01*** | (2006.01) |
| ***B66C 23/28*** | (2006.01) |
| ***B66C 23/62*** | (2006.01) |

(56) References Cited

U.S. PATENT DOCUMENTS

| | | | | |
|---|---|---|---|---|
| 2007/0289350 | A1 * | 12/2007 | Kushida et al. | 72/274 |
| 2008/0302160 | A1 * | 12/2008 | Wang et al. | 72/221 |
| 2012/0037584 | A1 | 2/2012 | Müller | |
| 2012/0067841 | A1 | 3/2012 | Müller | |

FOREIGN PATENT DOCUMENTS

| | | | | |
|---|---|---|---|---|
| GB | 2 390 125 | A | | 12/2003 |
| GB | 2390125 | A | * | 12/2003 |
| JP | 61 017323 | A | | 1/1986 |
| JP | 8 238520 | A | | 9/1996 |
| JP | 9 038722 | A | | 2/1997 |
| JP | 11057820 | A | * | 3/1999 |
| JP | 2006 009380 | A | | 1/2006 |

* cited by examiner

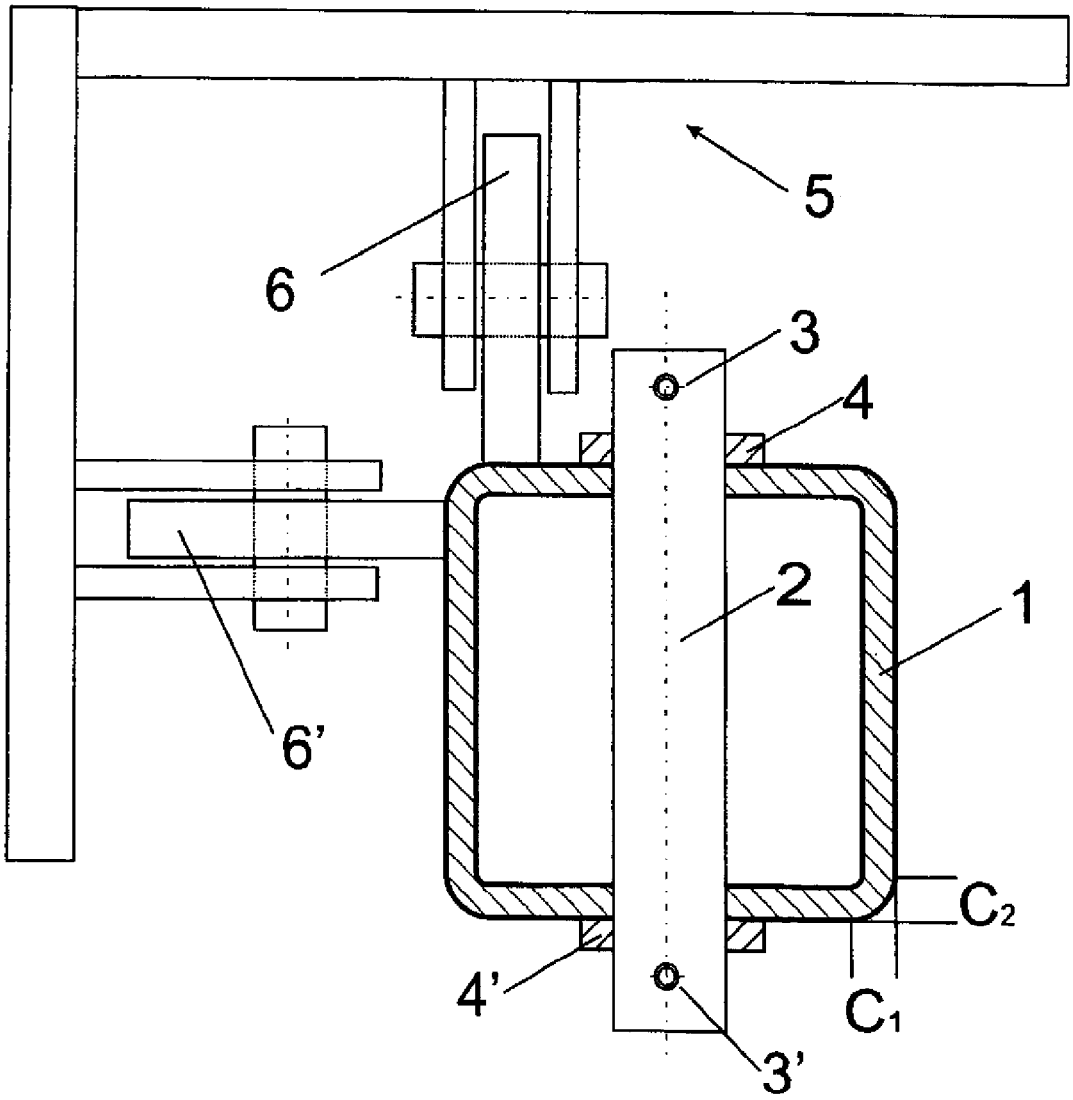
5
6
3
4
2
1
6'
C2
4'
C1
3'

METHOD FOR PRODUCING HOT ROLLED HOLLOW SECTIONS HAVING A RECTANGULAR CROSS-SECTION AND SMALL EDGE RADII

CROSS-REFERENCES TO RELATED APPLICATIONS

This application is the U.S. National Stage of International Application No. PCT/DE2010/000974, filed Aug. 12, 2010, which designated the United States and has been published as International Publication No. WO 2008/049764 and which claims the priority of German Patent Application, Serial No. 10 2009 039 710.8, filed Aug. 28, 2009, pursuant to 35 U.S.C. 119(a)-(d).

BACKGROUND OF THE INVENTION

The invention relates to a method for producing hot-rolled hollow sections of steel. Furthermore, the invention relates to a hollow section produced by this method as well as to the use of such a hollow section. In particular involved are hollow sections which deviate from the circular shape such as for example hot-finished hollow sections according to EN 10210-2.

The hot-rolled hollow sections known as MSH®-sections can be produced from cold-finished longitudinally seam-welded pipe blanks as well as from hot-finished seamless pipe blanks having a substantially round starting cross section.

When using cold-finished longitudinally seam-welded pipe blanks, a round pipe is produced from a steel strip formed into an open seam tube, usually by means of HFI welding, and, after being heated to forming temperature, is hot-rolled in respective section rolling stands into a hollow section.

When using hot-finished seamless pipe blanks, the latter are either re-heated at the same heat or to rolling temperature and then formed with respective rolls to a hollow section having the required rectangular or square cross section.

Accordingly produced hollow sections are primarily used as construction pipes in addition to the classic field of use in steel frame superstructures increasingly also in industrial construction, sports facility construction, bridge construction and mechanical engineering, in machinery for structural engineering, special vehicle construction, commercial vehicle construction, agricultural machinery construction as well as in steel construction and building construction.

Increasing demands for environmentally friendly and more economical methods of construction have led to the development of hot-rolled hollow sections that, with regard to the required geometrical moment of inertia or section modulus, are lighter in weight or have a greater cross section, while having same nominal dimension (edge length×nominal wall thickness), and compared to hollow sections which for example are produced from bent sheet metal by cold-finishing, have significantly smaller edge radii or visible edges.

Because in practice, the edge radii of the hollow sections are uneven, EN 10210-2 does not specify the outer rounding radii but the lengths of the rounding regions, referred to in the following as visible edges.

The advantages of smaller visible edges in hollow sections are, on one hand, a greater geometrical moment of inertia and greater bending and torsion stiffnesses, and, on the other hand, a smaller welding joint is established at connections in the region of the section edge and thus a more appealing appearance, which is very important for exposed constructions.

Moreover, a wider support area for cross sections to be connected is realized so that the load-carrying capacity is increased. Moreover, a force can at least partially be introduced rectilinear into a section wall extending parallel to the force, when the visible edge is smaller than the wall thickness, a fact which is advantageous for static dimensioning.

Hot-finished hollow sections with a maximum permissible visible edge according to EN 10210-2 of ≤3.0×t (t=wall thickness) are, however, no longer adequate for all fields of application.

An example involves the field of application for rotating tower cranes with climbing capability for high-rise building construction. In these cranes, the tower height, and with this the crane height and hook height, are increased incrementally by inserting tower elements, and are thus adjusted to the progress of the building construction.

The tower elements are assembled from square or rectangular hollow sections, wherein the vertically extending corner sections of the tower element, the so called "corner posts", are connected to one another by bolts arranged in the middle of the hollow section.

For adding tower elements, a guiding frame is used along the vertically extending corner sections of the tower element and has guide rollers which have to run very close to the section edge for reasons of space as a result of the bolted connection. When the visible edges are too large, the guide rollers would run too far in the middle of the hollow section so that the individual tower elements could no longer be connected by the bolts.

Further fields of application for hollow sections with smaller visible edges are, e.g., the bottom chords of outriggers of trolley-type rotating tower cranes to provide a wider support surface for the trolley rolls or generally sections which are subjected to bending stress, e.g. the crane track support system of steel for high loads known from DE 10 2007 031 142 and the support system of steel for roof construction known from DE 10 2006 010 951.

The maximum permissible value for the visible edge length $C_1$ and $C_2$ of ≤3.0×t for hot-finished hollow sections according to EN 10210-2, is clearly too high for the aforementioned fields of application. According to EN 10210, as a matter of principle, a value of 1.5×t is therefore used as a basis for calculation.

Heretofore, the use of a rolling process has not been successful to reduce the lengths of visible edges in hollow sections made from cold-finished welded or hot-finished seamlessly produced pipe blanks so as to render these hollow sections economically useful for the described fields of application. Therefore, a compromise was always sought between rolling capability of the hollow section, wear of the rolls, and the visible edge length; this however has not led to the desired success.

For that reason, these applications predominantly involve the use of, for example, hollow sections which are formed by welding two L-shaped legs to one another, and which at ≤1.0×t have very small visible edge lengths and thus are significantly below the standard for hot-finished hollow sections.

However, as a result of the welding seam, these hollow sections formed by welding individual sections to one another have the disadvantage of non-homogenous material properties, and as a result of the internal stress of the welding seam carry an increased risk of warping and their manufacture is elaborate.

SUMMARY OF THE INVENTION

It is therefore an object of the invention to provide a method for producing hot-rolled hollow sections having a rectangular cross-section or a square cross-section and made from welded or seamlessly produced pipe blanks, with which method visible edge lengths with $C_1$ or $C_2 \leq 1.5 \times t$ can be realized in a simple and cost-efficient manner in the course of rolling of the hollow sections.

According to the teaching of the invention, this object is solved by a method for producing hot-rolled hollow sections of steel having a rectangular or square cross section, wherein initially a substantially round pipe blank having a defined outer nominal diameter is produced by seamless hot-rolling or cold-finished and welded and subsequently formed at forming temperature into a hollow section having the required cross-section, with the visible edges $C_1$ and $C_2$ of the hollow section having a value of $\leq 1.5 \times t$ (t=wall thickness), wherein for a Predefined cross section of the section, the pipe blank which is to be inserted into the rolling mill has an increased diameter compared to the normally used nominal outer diameter, which increased diameter is determined from a reduction ratio to be achieved of the pipe blank and the dimensions to be achieved of the hollow section, wherein the reduction ratio to be achieved lies within a range of −2.0% to −13% and is determined according to the following formula:

$$\text{Reduction ratio } R[\%]=[(2\times(H+B))-\pi\times D]\times 100\%/[2\times(H+B)].$$

Advantageous refinements as well as a hollow section produced with this method are the subject matter of sub claims.

Extensive tests have surprisingly shown that, at a predetermined groove of the rolls, using a diameter of the pipe blank which is increased compared to a standard pipe blank diameter, significantly improves filling of the roll groove in the edge regions and as a result allows significantly smaller visible edges to be realized.

A corresponding selection of the reduction ratio of the pipe blank or the pipe blank diameter not only allows to realize visible edge lengths of $\leq 1.5 \times t$, but even visible edge lengths of $\leq 1.0 \times t$ or $\leq 0.6 \times t$.

However, as the tests have also shown, when the pipe blank diameter is too large, i.e. an excessive reduction ratio compared to the standard pipe blank diameter, there is an increased risk of a roll seizure, in which the pipe to be formed as propelled by the rolls is no longer advanced even before leaving the forming zone and becomes stuck in the rolling stand.

In addition, exceeding a certain pipe blank diameter involves the risk of material migrating into the roll gap to thereby cause formation of a burr or bead, which subsequently has to be elaborately machined down.

In the case of a pipe blank diameter which is too small compared to the standard pipe blank diameter, i.e. when the reduction ratio is too small, the filling of the roll groove is insufficient in the radii regions and a sufficiently small visible edge is not created.

Complying with the required reduction ratio therefore creates relatively narrow limits for increasing the pipe blank diameter according to the invention, wherein reduction ratios of −2.2% to −4.0% have proven advantageous for visible edge lengths $\leq 1.0 \times t$ and of $<-4\%$ for visible edge lengths $\leq 0.6 \times t$.

According to an advantageous refinement of the invention, these values can even be achieved without a change in sizing the rollers compared to when using a standard pipe blank diameter.

The advantage of the method according to the invention is that compared to the hollow sections made by welding individual sections together, very economically producible hot-rolled hollow sections can also be used in fields of application, in which they could not be used before because thus far the visible edge lengths were too great.

The following examples illustrate the effectiveness of the invention.

Customer specification: $C_1$ or $C_2 \leq 1.0 \times t$ according to EN 10210-2

EXAMPLE 1

| | |
|---|---|
| Required dimension of the hollow section (H × B × t) | 220 × 220 × 16 mm |
| Circumference of the hot pipe blank (U): | 889.07 mm |
| Calculated reduction ratio: | −1.02 |
| Measured visible edge length $C_1$ or $C_2$ | 21 mm |
| Determined factor $C_1/t$ or $C_2/t$ | 21/16 = 1.3 (not satisfied) |

EXAMPLE 2

| | |
|---|---|
| Required dimension of the hollow section (H × B × t) | 220 × 220 × 16 mm |
| Circumference of the hot pipe blank (U): | 907.92 mm |
| Calculated reduction ratio: | −3.08 |
| Measured visible edge length $C_1$ or $C_2$ | 14 mm |
| Determined factor $C_1/t$ or $C_2/t$ | 14/16 = 0.9 (satisfied) |

EXAMPLE 3

| | |
|---|---|
| Required dimension of the hollow section (H × B × t) | 220 × 220 × 16 mm |
| Circumference of the hot pipe blank (U): | 927.43 mm |
| Reduction ratio: | −5.11% |
| Measured visible edge length $C_1$ or $C_2$ | 9 mm |
| Determined factor $C_1/t$ or $C_2/t$ | 9/16 = 0.6 (satisfied) |

BRIEF DESCRIPTION OF THE DRAWING

In the following, an exemplary embodiment for using a hollow section according to the invention is described in greater detail by way of a sectional representation.

The single FIGURE shows a detail of a tower element of a revolving tower crane using hollow sections produced according to the invention with small visible edges as construction element.

DETAILED DESCRIPTION OF PREFERRED EMBODIMENTS

The hollow section 1 of the tower element is configured as vertically extending tower corner section "corner post". The visible edges of the hollow section are designated $C_1$ and $C_2$.

The connection to the tower element to be added is implemented by using a bolt 2 which is inserted in midsection through the opposing leg of the hollow section 1 and connects the tower corner sections of the lower tower element to the tower corner section of the attached tower element.

The hollow section 1 is provided with reinforcement plates 4, 4' in the region of the bolted connection, and the bolt 2 is secured against loosening by cotter pins 3, 3'.

For adding the tower elements, a guiding frame 5 is used along the vertically extending tower corner section and includes guide rollers 6, 6' which have to run very close to the section edge for reasons of space because of the bolted connection. This can now be realized easily with the hot-rolled hollow section according to the invention in view of the very small visible edge length.

The invention claimed is:

1. A method for producing a hot rolled hollow section made of steel and having a rectangular or square cross section, comprising:

producing a substantially round pipe blank having a defined nominal outer diameter by seamless hot-rolling or cold-finishing and welding;

forming the pipe blank in a rolling mill at a forming temperature into a hollow section having visible edges defined by a value of ≤1.5×t, wherein t is a wall thickness of the hollow section; and determining the nominal outer diameter of the pipe blank as a function of a reduction ratio to be achieved of the pipe blank and dimensions to be achieved of the hollow section, wherein the reduction ratio lies within a range of −2% to −13% and is determined by the formula:

$$\text{Reduction ratio } R\ [\%]=[(2\times(H+B))-\pi\times DJ\times 100\%/[2\times(H+B)],$$

wherein

H is a height of the hollow section,

B is a width of the hollow section,

D is an outer diameter of the pipe blank at the forming temperature and before the forming step.

2. The method of claim 1, wherein the visible edges have a length which is ≤1.0×t, with the reduction ratio lying within a range of <−2.2% to −4%.

3. The method of claim 1, wherein the visible edges have a length which is ≤0.6×t, with the reduction lying within a range of <−4% and −13%.

4. The method of the claim 1, wherein the forming step includes using rolls sized for forming a standard diameter pipe blank.

* * * * *